United States Patent [19]

Palac

[11] Patent Number: 4,581,561

[45] Date of Patent: Apr. 8, 1986

[54] HIGH CONTRAST CATHODE RAY TUBE WITH INTEGRATED FILTER

[75] Inventor: Kazimir Palac, Carpentersville, Ill.

[73] Assignee: Zenith Electronics Corporation, Glenview, Ill.

[21] Appl. No.: 450,614

[22] Filed: Dec. 17, 1982

[51] Int. Cl.[4] ..... H01J 29/18; H01J 29/28

[52] U.S. Cl. ..... 313/474; 313/112

[58] Field of Search ..... 313/469, 474, 473, 461, 313/466, 112; 350/311; 252/582, 585, 586; 427/165

[56] References Cited

U.S. PATENT DOCUMENTS

| | | | |
|---|---|---|---|
| 2,072,115 | 3/1937 | Leverenz | 313/469 X |
| 2,567,714 | 9/1951 | Kaplan | 313/474 |
| 2,828,217 | 3/1958 | Levin et al. | 117/33.5 |
| 2,959,483 | 11/1960 | Kaplan | 96/34 |
| 3,468,745 | 9/1969 | Navez et al. | 350/311 X |
| 3,748,515 | 7/1973 | Kaplan | 313/474 X |
| 3,891,440 | 6/1975 | Gallaro et al. | 313/474 X |

FOREIGN PATENT DOCUMENTS

| | | | |
|---|---|---|---|
| 54-129873 | 10/1979 | Japan | 313/474 |

*Primary Examiner*—Palmer C. DeMeo
*Assistant Examiner*—K. Wieder
*Attorney, Agent, or Firm*—Cornelius J. O'Connor

[57] ABSTRACT

The invention concerns a novel image reproducing structure for use in a cathode ray tube. This structure comprises a glass substrate which is transmissive of visible light and has a screen supporting target surface on one side thereof and a viewing surface on the opposite side. The screen comprises a phosphor deposit which is applied to at least a portion of the target surface and responds to electron beam impingement thereon to produce a visible image of a predetermined hue. The image reproducing structure further includes filter means in the form of a stain that permeates an area of the glass substrate to form an integral part thereof and exhibits a predetermined different hue. The stain permeated area is interposed between at least a part of the phosphor deposit and the substrate viewing surface.

9 Claims, 5 Drawing Figures

HIGH CONTRAST CATHODE RAY TUBE WITH INTEGRATED FILTER

CROSS REFERENCE TO RELATED PATENTS

The phosphor screens exemplified in the image display devices disclosed herein may be processed in accordance with methods described and claimed in the following patents: U.S. Pat. No. 2,828,217 which issued to N. D. Levin et al on Mar. 25, 1958 and in U.S. Pat. No. 2,959,483 which issued to Sam H. Kaplan on Nov. 8, 1960.

BACKGROUND OF THE INVENTION

This invention relates, in general, to cathode ray tube display devices for producing images of enhanced contrast and, in particular, to a novel screen structure for achieving such contrast.

The contrast of an image reproduced upon the screen of cathode ray tube is adversely affected by ambient light incident upon the viewing surface of the tube's face plate. This obtains because that portion of the ambient light reflected back from the screen tends to desaturate the reproduced image. On the other hand, contrast is enhanced if reflectance, which can be considered a ratio of the quantity of reflected light, to total incident light, is kept minimal. Accordingly, in any image reproducing device for use in home entertainment apparatus, such as television receivers, as well as those devices employed in computer display terminals, it is important that the display presented to the viewer (terminal operator) exhibit minimal reflectance while still maintaining acceptable brightness and resolution.

In addition to attractive reflectance and brightness characteristics a consideration of particular concern, as respects display monitors used in conjunction with computer terminals, is the hue or coloration of the displayed image. In this regard, and in certain situations, it has been determined that a computer terminal operator experiences less eye fatigue when viewing an amber tinted display than when looking at the conventional greenish color exhibited by the excited phosphor of a conventional computer display device.

One solution to the problem is to epoxy bond a filter, in the form of an amber tinted sheet of plastic material, to the faceplate of the display device. While this does provide an amber tinted image, the application of the filter is not without problems. First, the amber tinted material is not inexpensive. Secondly, epoxy bonding the filter to the faceplate is a disagreeable chore, to say the least, which is followed, in turn, by the equally onerous task of removing excess epoxy from the perimeter of the faceplate, as well as from the funnel portion of the tube. Finally, a particularly objectionable problem with this filter arrangement is that, in use, the plastic sheet easily succumbs to scratches.

In the field of tri-color image display devices for television receivers, there has been and continues to be, extensive activity toward the development of screens which have attractive reflectance and brightness properties but, which do not overly cost burden the manufacturing process. An early advance in this art is the subject of U.S. Pat. No. 3,146,368 which issued on Aug. 25, 1964 to Joseph P. Fiore et al. This patent discloses a screen structure, now popularly referred to as a black-surround screen, which is characterized by the placement of light absorbing pigments between each of the phosphor deposits that form the screen structure. The implementation of the teaching of this patent permitted the brightness of mass produced tri-color picture tubes to be effectively doubled.

Another teaching, addressed to the improvement of the contrast and brightness aspects of the screen, is disclosed in U.S. Pat. No. 3,114,065, which issued on Dec. 10, 1963 to Sam H. Kaplan. Kaplan describes combining each of the three basic phosphor materials making up the tri-color screen with a filter that is highly transmissive of the color, or wavelength of light emitted by its associated phosphor material, but which otherwise is an attenuator throughout the visible spectrum. This filter was interposed, as a layer, between the phosphor and the inside surface of the face plate or, alternatively, the filter material could be mixed with the phosphor and the mixture applied to the elemental screen areas.

Another approach to achieve the advantages of black-surround, though structurally quite different, is disclosed in U.S. Pat. No. 3,569,761 which issued on Mar. 9, 1971 to Howard G. Lange. In this patent each elemental area of the screen, assigned to a particular color, is provided with a phosphor deposit and a filter. The phosphor emits light of the color appropriate to its assigned area while the filter is colormetrically related to be highly transmissive of that color but otherwise to serve as an attenuator for visible light. In addition, the filter elements extend over or bridge the spaces between the elemental areas of the screen so that these spaces receive at least two overlapping filter elements. Because of the characteristics of the various filters, the spaces intervening the elemental areas of the screen assigned to specific colors are provided with light attenuators and thus serve, essentially, the same function as the black-surround material described in the Fiore et al patent. While the Lange screen did achieve a black-surround type advantage without the re-etch requirement of Fiore et al, it did so at some sacrifice of screen brightness due, principally, to shortcomings inherent in the optical filter art.

Thereafter, and still in the pursuit of a tri-color tube having attractive reflectance and brightness properties, came the teaching in U.S. Pat. No. 3,812,394 which issued to Sam H. Kaplan on May 21, 1974. Basically, Kaplan here teaches the use of a red filter formed of a luster material applied over the entire surface of the screen except for those elemental screen areas reserved for blue phosphor deposits and green phosphor deposits. While an improved screen structure for a tri-color picture tube was achieved by Kaplan, the inherent shortcomings of the optical filter art was still a factor to be contended with.

It is therefore a principal object of the invention to provide a novel screen structure for enhancing the contrast of an image produced by a cathode ray tube display device.

It is also an object of the invention to provide a cathode ray tube screen structure that exhibits attractive brightness, as well as reflectance, properties.

It is anothe object of the invention to provide an improved screen structure amenable to economical manufacturing processes.

SUMMARY OF THE INVENTION

A cathode ray tube display device for producing an enhanced contrast image employs an image reproducing structure constructed in accordance with the invention. Basically, the inventive structure comprises a substrate, which is transmissive of visible light and, comprises a target surface on one side thereof and a viewing surface on the opposite side. A screen, comprising a phosphor deposit applied to at least a portion of the target surface, is responsive to electron beam impingement thereon to produce a visible image of a predetermined hue. A filter comprising a stain exhibiting a predetermined different hue, permeates an area of the substrate and forms an intergral part of the substrate. This stain permeated area of the substrate is interposed between at least a part of the phosphor deposit and the substrate viewing surface.

In another embodiment of the invention, specifically addressed to tri-color television cathode ray tube display devices, the screen comprises a multiplicity of sets of light emitting image elements disposed in an interleaved pattern upon the target surface of the substrate and an interstitial target surface area devoid of image elements. Each set of image elements includes a red phosphor deposit, a blue phosphor deposit and a green phosphor deposit. Each phosphor deposit, in turn, responds to impingement by an assigned one of three electron beams to produce a correspondingly colored visible image. In this embodiment the filter comprises a stain which exhibits a hue different from that of any of the phosphor deposits. As in the previously described embodiment, the stain permeates an area of the substrate to form an intergral part thereof and is interposed between, on the one hand, at least the phosphor deposits of a selected like color and the interstitial area and, on the other hand, the viewing surface of the substrate. The stain serves to enhance the contrast of the visible images produced by the phosphor deposits.

BRIEF DESCRIPTION OF THE DRAWINGS

The features of the present invention which are believed to be novel are set forth with particularity in the appended claims. The invention, together with further objects and advantages thereof, may best be understood by reference to the following description taken in connection with the accompanying drawings, in the several figures of which like reference numbers identify like elements and in which:

DESCRIPTION OF THE PREFERRED EMBODIMENT

Figure 1:
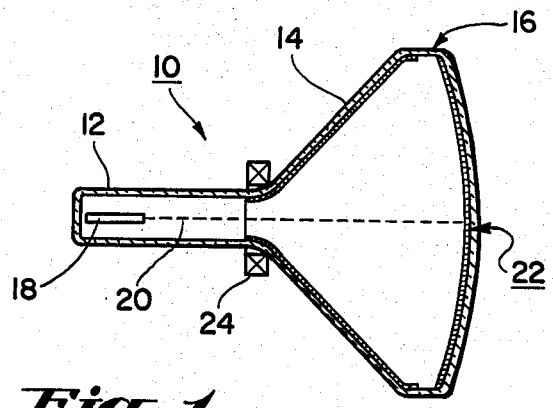
FIG. 1 is a cross-sectional view, partly schematic, of a monochrome image display device in whcih the inventive image reproducing structure finds application.

Referring now to FIG. 1, the cathode ray tube monochrome display device 10 there shown, comprises an evacuated envelope having, in the order named, a neck portion 12, a flared conical or funnel portion 14 and a faceplate section 16, the details of which will be described in connection with the discussion of FIG. 2. A gun assembly 18, which in this case consists of apparatus for generating and directing a single electron beam 20 toward a target, is located in the neck of the tube. The gun is oriented to project beam 20 along a predetermined path, then through a deflection field togward an image reproducing structure 22 incorporated in faceplace 16. Display device 10 is provided with the customary deflection control system which includes the deflection yoke 24.

Figure 2:
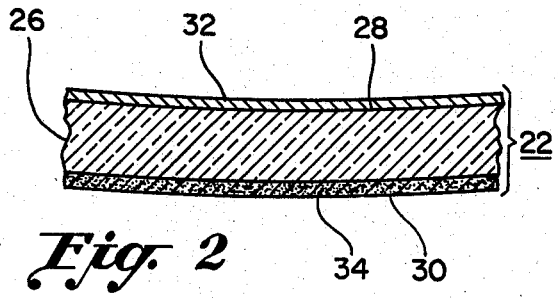
FIG. 2 is a cross-sectional view of a fragment of the novel image reproducing structure used in the display device shown in FIG. 1.

Turning to FIG. 2 wherein a fragment of the faceplate 16 is shown in cross-section and greatly enlarged, but not to scale, the image reproducing structure 22 incorporated in the faceplate is seen to comprise a substrate 26 which, preferably, is a composition of glass transmissive of visible light. Substrate 26 comprises an inwardly directed target surface 28 which confronts electron beam gun 18 and an outwardly directed viewing surface 30 through which an image, reproduced upon the target surface, is viewed. A luminescent screen, comprising the phosphor deposit 32, is applied to at least a portion of target surface 28. In practice, the phosphor material in a monochrome image display device is usually applied uniformly to the entire target surface of the substrate. In any event, phosphor deposit 32 responds to impingement by electron beam 20 to produce a visible image having a predetermined hue, which hue is determined by the constituency of the phosphor deposit.

Image reproducing structure 22 further includes a filter means comprising a stain 34 that exhibits a predetermined hue that is different from that of the beam generated image. As shown, stain 34 permeates an area of substrate 26 and actually forms an integral part of the substrate. This stain area is interposed between at least part of the phosphor deposit 32 and the substrate viewing surface 30 to enhance the contrast of the image produced by the excited phosphor deposit. More particularly, in the embodiment disclosed in FIG. 2, stain area 34 uniformly is disposed immediately beneath viewing surface 30.

FIG. 2 is illustrative of the case in which filter stain 34 is applied to a completed monochrome cathode ray tube. In this embodiment, a mixture comprised for a Ferro type M-4116 amber stain, which is available from Ferro Corporation in Pittsburgh, Pa. 15204, diluted to a fairly thin consistency with turpentine and a C-30 oil vehicle, also available from Ferro, is applied to viewing surface 30 of the faceplate by, preferably, a spray gun to insure a uniform coating of stain upon the viewing surface. After being allowed to dry, the tube with its coated faceplate is subjected to a predetermined bake-out temperature for a selected period of time. Depending upon the temperature, as well as the bake time, the stain will adopt a predetermined hue.

Insofar as forming the filter stain as an integral part of the substrate is concerned, the following method has been successfully reduced to practice, which method contemplates the following steps:

1. Scrub that surface of the substrate to receive the filter stain with an alconox solution.
2. Rinse the substrate with city water.
3. Wash the substrate with a 3% HF solution or a 6% solution of Ammonium Bifluoride for twenty to thirty seconds.
4. Rinse the substrate again with city water for approximately thirty seconds.
5. Rinse the substrate with D.I. water for ten seconds.

6. Air dry the substrate with clean filtered air.
7. Inspect thoroughly for particulates, etc., and remove any such impurities.
8. Install the tube, faceplate up, in a holding fixture in a spray booth and position a mask about the faceplate to confine application of stain to a selected area of the substrate surface. The mask serves to protect the funnel and other areas of the tube from over-spray.
9. Provide a stain mixture of the following formulation:
   100 grams Ferro Amber stain type M-4116 in a C-30 oil vehicle;
   20 grams turpentine;
   20 grams 33B10 RCA binder.
   Mix these ingredients thoroughly, making sure there are no agglomerates.
10. Apply a uniform coating of the stain formulation to the surface of the substrate with a spray gun.
11. Inspect. Discontinuities in the coated area of the substrate due either to bubbles, blisters, or missed areas, or particulates, etc., can not be tolerated. The coating thickness should be at least 1 mil thick when wet and opaque to light.
12. Dry the coated substrate in an exhaust drying oven at approximately 60 degrees Centigrade.
13. Introduce the dried coated substrate to a bake out lehr, taking care that the coating, when the tube is loaded onto the lehr belt, not contacted during loading nor in transport through the oven.
14. Set the oven temperature cycle, for whatever is safe for the particular glass substrate employed, on the upside and downside of the lehr. For a particularly pleasing amber hue, the coated substrate was baked at a peak temperature of 475 degrees Centigrade for one-half hour. It is appreciated of course, that other temperatures (higher or lower) and baking times (longer or shorter) will produce stains of differing hues. The temperature on the up and down cycle should be consistent, once established, for all tubes to insure uniform color and consistent filter depth.
15. Remove the tube from the lehr oven, clean the residue from the stained surface of the substrate with soap, or a mild detergent, and water and then rinse thoroughly.

As noted previously, during the bake out process the stain actually becomes an integral part of an area of the glass substrate. This obtains by virture of the fact that an ion exchange occurs between an alkali (sode) ion in the glass and a silver ion in the stain. As a result, the stain is permanently integrated into the glass and cannot thereafter be removed unless the integrated area of the glass itself is removed. The depth of penetration of the substrate by the stain is rather small, in actual practice the penetration is in the order of 15 microns which is more than sufficient to achieve its intended purpose.

The actual staining of the glass substrate takes place as follows. Initially, a base ion exchange reaction occurs in which silver ions exchange with alkali (sode) ions on the surface of the glass. Thereafter, an extension of the base ion exchange reaction occurs in which the exchanged silver ions diffuse into the glass, thus promoting permanency of the stain. Then, a reducing agent contained in the amber stain serves to reduce the diffused ions to silver metal. Finally, the actual amber hue develops by the conglomeration of silver crystals. When the staining process is completed, a residue forms on the surface of the glass which must be removed. In practice, this residue is readily removed with mild soap and water.

When a monochrome cathode ray tube having a filter stain applied in the manner described, is energized to produce a visible image, the image will be characterized by enhanced contrast. This obtains because ambient light incident upon the viewing surface of the substrate is initially attenuated in traversing the filter stain prior to encountering phosphor deposit 32. A portion of the light is absorbed while the remainder, which is reflected back toward the viewing surface 30, again traverses the stain filter experiencing additional attenuation. It has been determined by actual measurement that a stain formulated and applied in the manner described above, will reduce the amount of reflected white ambient light by a magnitude that gives a reflectance in the order of twenty to twenty-five percent.

Figure 3:
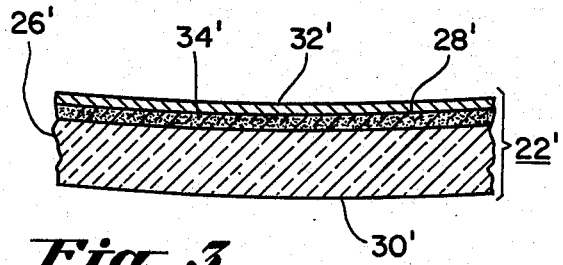
FIG. 3 is a cross-sectional view of a fragment of a novel, but differently formed, image reproducing structure for use in the display device of FIG. 1.

As noted above, dual attenuation of ambient light is afforded by interposing filter stain 34 between phosphor deposit 32 and viewing surface 30 of the substrate. In this regard it is appreciated that the filter stain can be integrated into a different area of the substrate, other than that already described, while still retaining the dual ambient attenuation feature. Accordingly, in another embodiment of the invention, again in the environment of a monochrome tube, see FIG. 3 (also not to scale), an image reproducing structure 22' is disclosed comprising a substrate 26' which has a target surface 28' and a viewing surface 30'. In this embodiment, a filter stain 34' is applied to target surface 28' so as to permeate an area of substrate 26' immediately beneath target surface 28.

In this case, the stain is applied to target surface 28' prior to the application of phosphor deposit 32'. More particularly, a cathode ray tube, while still in the format of an unprocessed bottle, that is, an envelope without a phosphor deposit or an electron gun, has the stain mixture sprayed upon the bare target surface 28' of the substrate. Filter stain 34' is then integrated into that area of substrate 26' using essentially the same procedure described above in connection with the forming of filter stain 34 shown in FIG. 2.

Alternatively, the stain mixture can be introduced to the target surface in slurry fashion and then decanted to provide a coating of desired thickness. The cathode ray tube with the stain applied to the target surface of the substrate is processed in the same manner described above, that is, dried, then heated at a predetermined temperature for a selected period of time until a filter stain of desired hue permeates the body of the substrate. As before, any residue is washed from the target surface so that the inside surface of the cathode ray tube envelope now comprises a clean glass substrate having a filter stain permeating and forming an integral part of that area of the substrate immediately beneath target surface 28. Since the substrate now presents a clean glass surface, the phosphor deposit can then be applied in a conventional manner by resort to well-known techniques. For example, an early teaching of a method for applying a luminescent monochrome screen to the faceplate of a cathode ray tube is described in the above-referenced U.S. Pat. No. 2,828,217 to Levin et al.

Figure 4:
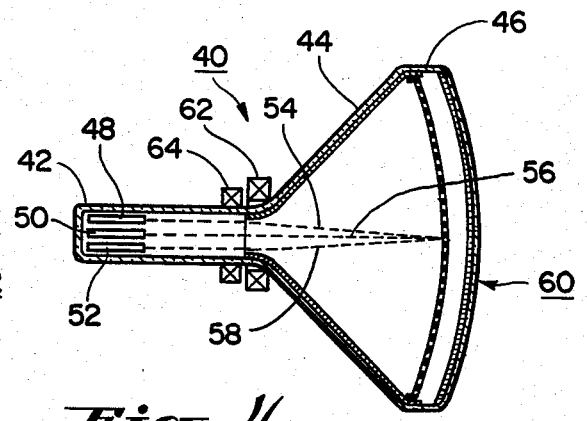
FIG. 4 is a cross-sectional view, partly schematic, of a color television image display device in which the inventive image reproducing structure also finds application.
Figure 5:
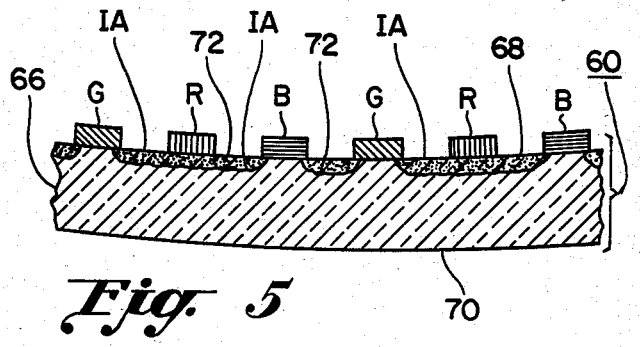
FIG. 5 is a cross-sectional view of a fragement of the image reproducing structure used in the color display device shown in FIG. 4.

Turning now to an application of the novel image reproducing structure to a color cathode ray tube, attention is directed to FIG. 4 which depicts such a tube 40 in a generally schematic form. This tube comprises an evacuated envelope having, in the order named, a neck portion 42, a funnel portion 44 and a face panel 46, the details of which will be described in connection with a discussion of FIG. 5. A gun assembly comprising the three electron guns 48, 50 and 52 is located in the neck of the tube. This assembly serves to generate and direct three electron beams 54, 56 and 58 along predetermined paths through a deflection field toward an image reproducing structure 60 incorporated in faceplate 46. Tube 40 is provided with a conventional deflection control system which includes a deflection yoke 62, and may also include a convergence system, represented in the drawing by the convergence coil 64, for converging beams 54, 56 and 58 in the region immediately adjacent faceplate 46.

A principal consideration in this embodiment is the desirability of applying the filter stain to the target surface of the substrate rather than to the viewing surface. The practicality of that choice will soon become evident. Accordingly, and with reference to FIG. 5 wherein a fragment of face panel 46 is shown in cross-section, greatly enlarged, but not to scale, the image reproducing structure 60 incorporated in the faceplate is seen to comprise a glass substrate 66 which is transmissive of visible light.

The substrate comprises an inwardly directed target surface 68 which confronts the beam generating gun assembly 48, 50, 52 as well as an outwardly directed viewing surface 70. In the case of color tube 40 the luminescent screen comprises a multiplicity of sets of light emitting image elemnts which are disposed in an interleaved pattern upon selected portions of target surface 68. Each set of the aforesaid image elements includes a red phosphor deposit R, a blue phosphor deposit B, and a green phosphor deposit G, which set may be in the form of a triad of dots or, in the alternative, adapt the format of a trio of elongated parallel disposed strips. Each of the phosphor deposits, in turn, responds to impingement by an assigned one of the electron beams to produce a correspondingly colored visible image. That portion of target surface 68 which is devoid of image elements can be said to constitute an interstitial surface area IA, and is so designated in FIG. 5.

The filter means in this embodiment comprises a stain 72 which exhibits a predetermined hue that is different from that of any of the phosphor deposits. As in the other embodiments of the invention, filter stain 72 permeates an area of substrate 66 to form an integral part thereof. This permeated area of the substrate is interposed between at least the phosphor deposits of a selected color, desirably the red phosphors R, and viewing surface 70 of the substrate so as to enhance the contrast of the images produced by the light emitting image elements. In a preferred embodiment for a color tube environment, the integrated filter stain 72 is also interposed between the interstitial area IA of the substrate target surface 68 and viewing surface 70 of the substrate.

The implementation of filter stain 72 into the image reproducing structure 60 of the color tube face panel 46 follows, in general, the method outlined above for creating a stain in the substrate of a monochrome picture tube. Insofar as the application of the stain to selected areas of substrate 66 is concerned, the basic techniques of color tube screening are employed. As is well known, the application of an image reproducing screen to the target surface of a color face panel is performed by electrophotographic techniques, a variety of which are well known and practiced in the art, see for example, the above-referenced U.S. Pat. No. 2,959,483 to Kaplan. In one such practice, a color selection electrode, in the form of a shadow mask, is employed as a template to establish a predetermined phosphor pattern upon the target surface.

In the case at hand, a clean face panel having a spotless target surface 68 is coated with a photoresist material, such as di-chromated polyvinyl alcohol (pvs) which contains an inert, sub-micron particle size material. The photoresist is then exposed, through a shadow mask, by an actinic light source at two different locations which simulate the sources of the electron beams assigned to exciting the blue and green phosphors. The actinic light serves to fix or harden, the photoresist material it illuminates thereby causing it to adhere to target surface 68. The face plate is then washed to remove the unexposed pva material from target surface 68 leaving behind deposits of pva corresponding to the future locations for the blue and green phosphors.

The stain material is now applied over the entire target surface including the hardened pva deposits. The substrate is then processed in substantially the same manner as that described above to integrate the stain into the substrate. The heating step employed in the process to integrate the stain with the substrate also serves to pyrolyze the pva so that only the inert material contained in the photosensitive pva remains, in addition, of course to the residue from the stain mixture. After a stain of desired hue has permeated the substrate, target surface 68 is again washed, this time to remove the stain residue as well as the inert material which had been contained in the photosensitized pva which, by virture of being pyrolyzed, exhibits little or no adherence to the glass target surface and therefore is easily washed away. The face panel 46 now comprises a substrate 66 having a filter stain 72 permeating the body of the substrate immediately beneath those areas of the target surface reserved for the red phosphors, as well as beneath the entire interstitial are IA, that is, the area surrounding the surface areas assigned to receive the blue and green phosphors. The target surface areas assigned to receive the blue and green phosphors are not stained because the stain material was prevented from entering the glass substrate because of the hardened pva deposits occupying those areas.

The substrate target surface 68 is now ready to receive the red, blue and green phosphors, which are applied by recourse to conventional electrophotographic screening techniques. At the completion of the screening operation the face panel now comprises a glass substrate 66 having an amber stain 72 permeating the target surface beneath the red phosphors as well as beneath the interstitial area between the blue and green phosphors. Accordingly, since only the blue and green phosphor areas of the screen do not have filter stain, approximately 65 to 75 percent of the screen surface is provided with a filter for attenuating ambient light reflection. Thus, a color cathode ray tube constructed in accordance with this process exhibits a very attractive brightness, as well as reflectance, properties.

It should be apparent at this juncture that it would not be practical to apply the amber stain to the outer or viewing surface of a color cathode ray tube face plate, not only because of the difficulty that would be encountered in attempting to accurately align the stain material over the red phosphor areas and the interstitial area of the target surface, but also because of a parallax problem. This can be appreciated when one realizes that, in such a construction, the filter stain would be physically spaced from the red phosphors and the interstitial area by the thickness of the face panel substrate, thus occasioning the parallax problem.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. An image reproducing structure for use in an image display device comprising:

a substrate transmissive of visible light and comprising a target surface on one side thereof and a viewing surface on the opposite side;

a screen comprising a phosphor deposit applied to at least a portion of said target surface and responsive to electron beam impingement thereon for producing a visible image of predetermined hue; and filter means, comprising a stain exhibiting a predetermined different hue permeating an area of said substrate and forming an integral part of said substrate and interposed between at least a part of said phosphor deposit and said substrate viewing surface.

2. A cathode ray tube display device for producing an enhanced contrast image, comprising:

means for generating at least one electron beam and for directing said beam toward a target;

a substrate transmissive of visible light and comprising an inwardly directed target surface confronting said beam generating and directing means and an outwardly directed viewing surface;

a screen comprising a phosphor deposit applied to at least a portion of said target surface and responsive to impingement by said electron beam to produce a visible image of predeterminded hue;

and a filter means, comprising a stain exhibiting a predetermined different hue permeating an area of said substrate and forming an integral part of said substrate interposed between at least a part of said phosphor deposit and said substrate viewing surface for enhancing the contrast of said image produced by said phosphor deposit.

3. A multi-color cathode ray tube display device for producing an enhanced contrast image, comprising:

means for generating a plurality of electron beams and for directing said beams toward a target;

a substrate transmissive of visible light and comprising an inwardly directed target surface confronting said beam generating and directing means and an outwardly directed viewing surface;

a screen comprising a multiplicity of sets of light emitting image elements disposed in an interleaved pattern upon said target surface, each set of said image elements including a red phosphor deposit, a blue phosphor deposit and a green phosphor deposit, each of said phosphor deposits responsive to impingement by an assigned one of said electron beams to produce a correspondingly colored visible image;

and filter means comprising a stain exhibiting a predetermined hue, different from that produced by any of said phosphor deposits, permeating an area of said substrate and forming an integral part of said substrate and interposed between at least the phosphor deposits of a selected like color and said viewing surface of said substrate for enhancing the contrast of said visible images produced by said phosphor deposits.

4. A multi-color cathode ray tube display device for producing an enhanced contrast image, comprising:

means for generating a plurality of electron beams and for directing said beams toward a target;

a substrate transmissive of visible light and comprising an inwardly directed target surface confronting said beam generating and directing means and an outwardly directed viewing surface;

a screen comprising a multiplicity of sets of light emitting image elements disposed in an interleaved pattern upon said target surface and an interstitial target surface area devoid of image elements, each set of said image elements including a red phosphor deposit, a blue phosphor deposit and a green phosphor deposit, each set of said elements responsive to impingement by an assigned one of said electron beams to produce a correspondingly colored visible image;

and filter means comprising a stain exhibiting a predetermined hue, different from that produced by any of said phosphor deposits, permeating an area of said substrate and forming an integral part of said substrate and interposed between, at least the phosphor deposits of a selected like color and said interstitial area and said viewing surface of said substrate for enhancing the contrast of said visible images produced by said phosphor deposits.

5. An image reproducing structure as set forth in claim 1 in which said filter stain permeates that area of said substrate immediately beneath said viewing surface of said substrate.

6. An image reproducing structure as set forth in claim 1 in which said filter stain permeates that area of said substrate immediately beneath said phosphor deposit.

7. A monochrome cathode ray tube display device for producing an enhanced contrast image, comprising:

means for generating at least one electron beam and for directing said beam toward a target;

a substrate transmissive of visible light and comprising an inwardly directed target surface confronting said beam generating and directing means and an outwardly directed viewing surface;

a screen comprising a phosphor deposit applied to said target surface and responsive to impingement by said electron beam to produce a visible image of predetermined hue;

and a filter means, comprising a stain exhibiting a predetermined different hue permeating an area beneath said viewing surface and forming an integral part of said substrate for enhancing the contrast of said image produced by said phosphor deposit.

8. A multi-color cathode ray tube display device as set forth in claim 3 in which said filter strain permeates that area of said substrate immediately beneath said phosphor deposits of said selected like color.

9. A multi-color cathode ray tube display device as set forth in claim 4 in whcih said filter stain permeates that area of said substrate immediately beneath said phosphor deposits of said selected like color and that area immediately beneath said interstitial surface area.

* * * * *